US010006429B2

(12) United States Patent
Battiston et al.

(10) Patent No.: US 10,006,429 B2
(45) Date of Patent: Jun. 26, 2018

(54) VARIABLE-AREA POPPET NOZZLE ACTUATOR

(71) Applicant: GM Global Technology Operations LLC, Detroit, MI (US)

(72) Inventors: Paul A. Battiston, Clinton Township, MI (US); Robert D. Straub, Lowell, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 58 days.

(21) Appl. No.: 15/086,968

(22) Filed: Mar. 31, 2016

(65) Prior Publication Data

US 2017/0284355 A1 Oct. 5, 2017

(51) Int. Cl.
*F02M 51/06* (2006.01)
*F02M 51/08* (2006.01)
(Continued)

(52) U.S. Cl.
CPC ..... *F02M 63/0056* (2013.01); *F02M 51/06* (2013.01); *F02M 61/08* (2013.01);
(Continued)

(58) Field of Classification Search
CPC ..... F02M 2200/705; F02M 63/0029; F02M 63/0056; F02M 63/0035; F02M 2200/70; F02M 63/04; F02M 2200/02; F02M 2200/03; F02M 2200/09; F02M 2200/26; F02M 2200/304; F02M 2200/31; F02M 2200/703; F02M 2200/706; F02M 2547/00; F02M 51/06; F02M 61/08; F04B 53/129; F04B 49/03
USPC ..... 238/533.7; 123/447, 448, 454, 456; 239/102.2, 533.7, 533.3, 533.4, 533.5, 239/447, 448, 454, 456
See application file for complete search history.

(56) References Cited

U.S. PATENT DOCUMENTS 5,526,791 A * 6/1996 Timmer ..... F02M 63/0003 123/467
5,697,554 A * 12/1997 Auwaerter ..... F02M 51/0603 239/584

(Continued)

FOREIGN PATENT DOCUMENTS

DE 10203655 A1 1/2004
DE 10259802 A1 7/2004
DE 10343086 A1 5/2005

*Primary Examiner* — Darren W Gorman
*Assistant Examiner* — Joseph A Greenlund
(74) *Attorney, Agent, or Firm* — Harness, Dickey & Pierce, P.L.C.

(57) ABSTRACT

A fuel injector includes a housing defining a longitudinal bore having a proximal end and a distal end, a high pressure fuel duct in communication with the longitudinal bore and a valve seat including a valve seat surface and an aperture at the distal end of the longitudinal bore. A poppet valve is disposed in the longitudinal bore and includes a valve head that is engageable with the valve seat surface. An actuator device is disposed at the proximal end of the longitudinal bore and a hydraulic coupler is disposed between the actuator and the poppet valve within the longitudinal bore. The hydraulic coupler defines a chamber that receives low pressure fuel for providing a hydraulic lash adjuster between the actuator and the poppet valve.

1 Claim, 3 Drawing Sheets

(51) Int. Cl.
*F02M 63/00* (2006.01)
*F02M 61/08* (2006.01)

(52) U.S. Cl.
CPC .... *F02M 63/0029* (2013.01); *F02M 63/0035* (2013.01); *F02M 2200/705* (2013.01); *F02M 2200/706* (2013.01)

(56) References Cited

U.S. PATENT DOCUMENTS 6,062,489 A * 5/2000 Tokumaru ..... F02M 47/027 239/102.2
6,161,773 A * 12/2000 Camplin ..... F02M 45/12 239/533.4
6,484,699 B2 * 11/2002 Paul ..... F02D 19/10 123/525
7,258,283 B2 * 8/2007 Heinz ..... F02M 51/0603 239/102.2
7,422,006 B2 * 9/2008 Noller ..... F02M 51/0603 123/446
7,546,961 B2 * 6/2009 Cristiani ..... F02M 51/0671 239/456
7,712,684 B2 * 5/2010 Masuda ..... F02M 61/08 239/453
8,500,036 B2 * 8/2013 Venkataraghavan F02M 47/027 239/102.2
8,864,054 B2 * 10/2014 Burger ..... F02M 47/027 239/533.11
9,624,886 B2 * 4/2017 Schmieder ..... F02M 51/0603
9,810,179 B2 * 11/2017 Jaegle ..... F02M 21/0263
2003/0132317 A1 * 7/2003 Kienzler ..... F02M 47/027 239/533.2
2006/0289681 A1 * 12/2006 Boecking ..... F02M 45/086 239/533.3
2011/0239991 A1 * 10/2011 Straub ..... F02M 51/0603 123/476
2014/0117121 A1 * 5/2014 Nong ..... F02M 51/061 239/584
2015/0108246 A1 * 4/2015 Stucchi ..... F02M 61/08 239/102.2
2015/0122220 A1 * 5/2015 Cecur ..... F01L 1/24 123/321
2017/0284355 A1 * 10/2017 Battiston ..... F02M 63/0029

* cited by examiner

VARIABLE-AREA POPPET NOZZLE ACTUATOR

FIELD

The present disclosure relates to fuel injectors and more particularly to an actuator of a variable-area poppet nozzle fuel injector.

BACKGROUND

This section provides background information related to the present disclosure which is not necessarily prior art.

A fuel injector is supplied with a pressurized fuel supply that the injector delivers to a combustion chamber of an internal combustion engine. The injector may include an actuation member and a valve mechanism to selectively open and close a fuel flow path from the pressurized fuel supply to the combustion chamber. A variable-area poppet injector is direct acting and can include an actuator stroke of less than 40 μm in order to provide a variable stroke stem lift of less than 15 μm. Lash can occur in the actuation stack-up due to thermal expansion, pressure expansion and part variation. Lash can reduce the transfer of motion between the electrical actuator and the injector stem and hinder the accuracy of the injector control. Accordingly, it is desirable to reduce the lash that can occur between components of a variable-area poppet injector.

SUMMARY

This section provides a general summary of the disclosure, and is not a comprehensive disclosure of its full scope or all of its features.

A fuel injector includes a housing defining a longitudinal bore having a proximal end and a distal end, a high pressure fuel duct in communication with the longitudinal bore and a valve seat including a valve seat surface and an aperture at the distal end of the longitudinal bore. A poppet valve is disposed in the longitudinal bore and includes a valve head that is engageable with the valve seat surface. An actuator device is disposed at the proximal end of the longitudinal bore and a hydraulic coupler is disposed between the actuator and the poppet valve within the longitudinal bore. The hydraulic coupler defines a chamber that receives low pressure fuel for providing a hydraulic lash adjuster between the actuator and the poppet valve.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
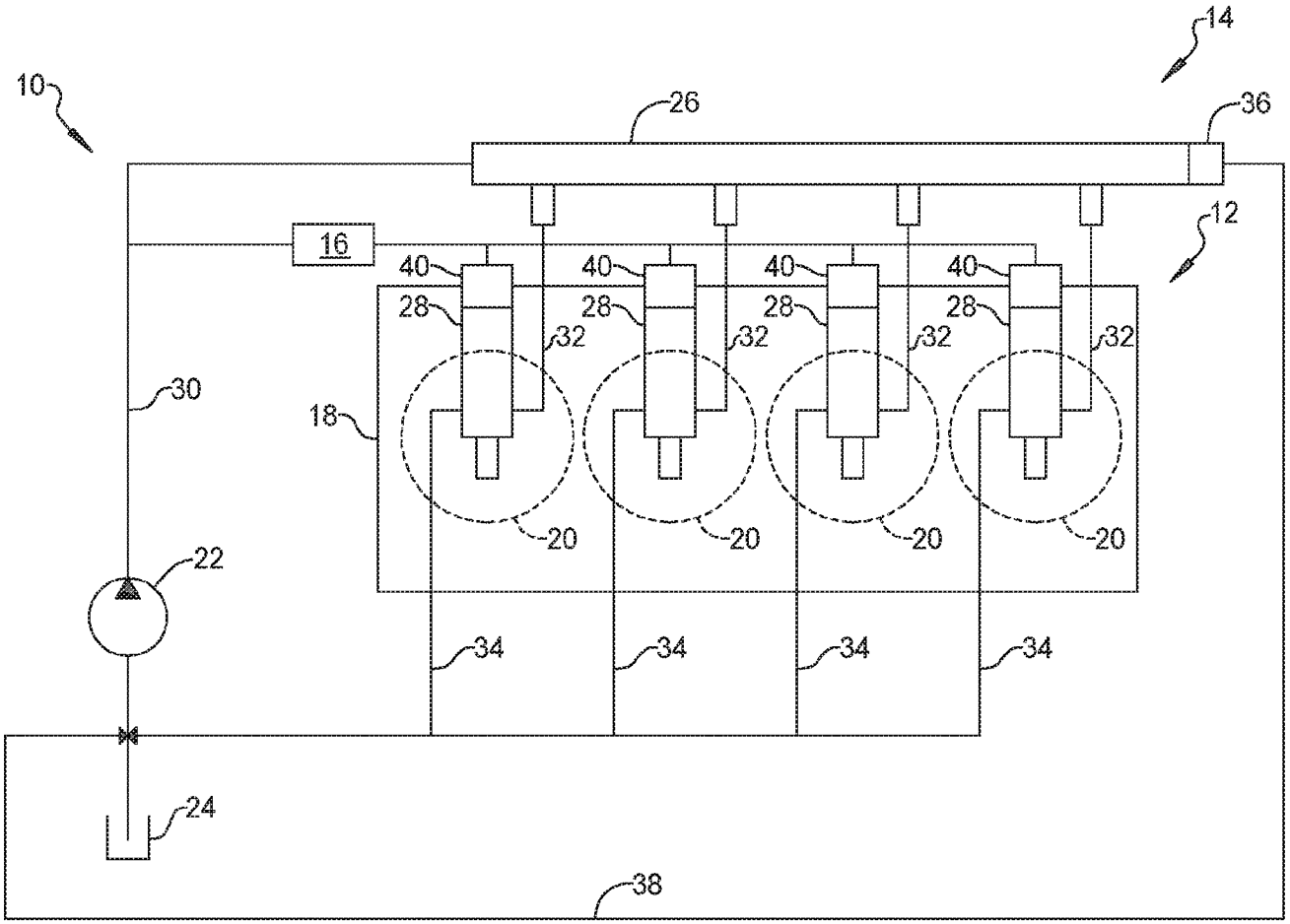
FIG. 1 is a schematic illustration of an engine assembly according to the present disclosure.

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

Referring to FIG. 1, an exemplary engine assembly 10 is schematically illustrated. The engine assembly 10 may include an engine 12 in communication with a fuel system 14 and a control module 16. In the example shown, the engine 12 may include an engine block 18 that defines a plurality of cylinders 20 in communication with the fuel system 14. While the engine 12 is illustrated as a four cylinder engine in the present disclosure it is understood that the present teachings apply to a variety of engine configurations and is in no way limited to the configuration shown.

The fuel system 14 may include a fuel pump 22, a fuel tank 24, a fuel rail 26, fuel injectors 28, a main fuel supply line 30, secondary fuel supply lines 32 and fuel return lines 34. The fuel pump 22 may be in communication with the fuel tank 24 and may provide a pressurized fuel supply to the fuel rail 26 via the main fuel supply line 30. The fuel rail 26 may provide the pressurized fuel to injectors 28 via the secondary fuel supply lines 32. The fuel rail 26 may include a pressure regulating valve 36 that regulates fuel pressure within the fuel rail 26 by returning excess fuel to the fuel tank 24 via a return line 38.

The fuel injectors 28 may each include an actuator assembly 40 in communication with the control module 16. In the present non-limiting example, the fuel injectors 28 may form direct injection fuel injectors where fuel is injected directly into the cylinders 20. The fuel injectors 28 may return excess fuel to the fuel tank 24 via the fuel return lines 34.

Figure 2:
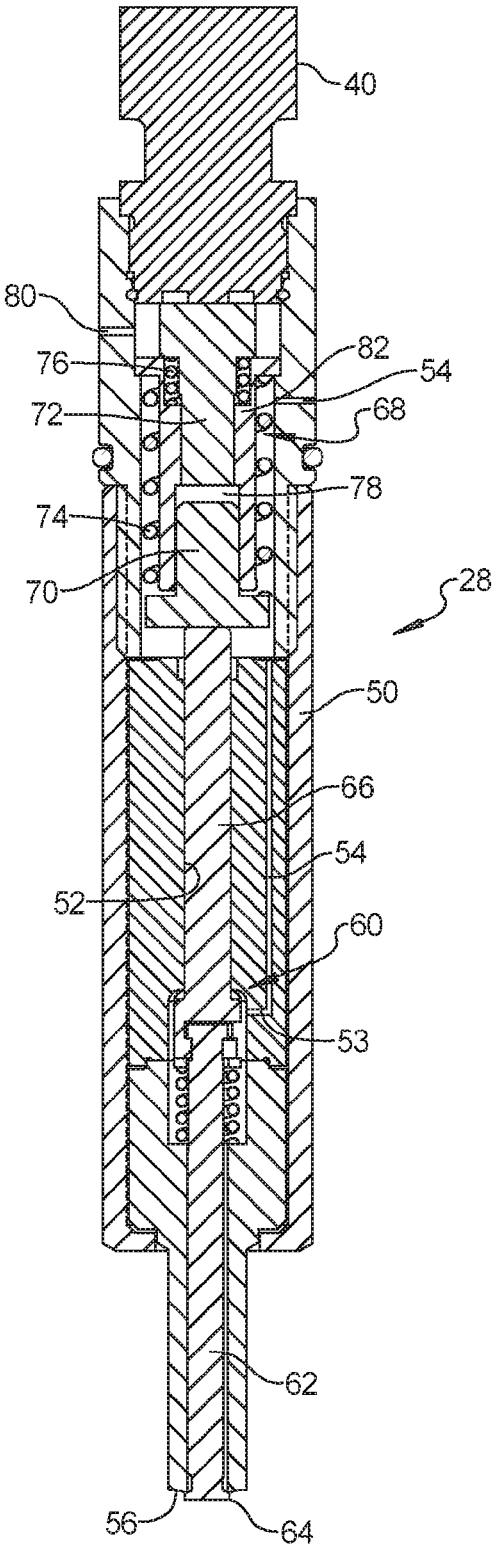
FIG. 2 is a cross sectional view of a variable area poppet nozzle actuator having a hydraulic coupler according to the principles of the present disclosure.

Referring to FIG. 2, an exemplary fuel injector 28 according to the present disclosure is illustrated. The fuel injector 28 may include a housing 50. The housing 50 may be formed from one or more pieces and can define a longitudinal bore 52 and a high pressure fuel duct 54. The longitudinal bore 52 may be in communication with the high pressure fuel duct 54 at a fuel inlet port 53. The housing 50 may further define a valve seat surface 56 in communication with the longitudinal bore 52.

Fuel injector 28 may include a poppet valve assembly 60 disposed within the longitudinal bore 52. The poppet valve assembly 60 may include a stem 62 and a valve head 64. In a first position of the poppet valve assembly 60, i.e., the closed position, the valve head 64 may abut the valve seat 56 to seal the distal end of the longitudinal bore 52. In a second position of the poppet valve assembly 60, i.e., the fully opened position, the valve head 64 may open the aperture at the distal end of the longitudinal bore 52 to the maximum extent allowed to spray pressurized fuel into the cylinder 20 in which the fuel injector 28 is inserted. The poppet valve assembly 60 may be variably displaceable such that the valve head 64 may be moved to a plurality of positions between the first (closed) position and the second (fully opened) position. In this manner, the poppet valve assembly 60 may vary the size of the valve opening, which provides a variable amount of fuel and/or fuel flow rate to the cylinder 20.

The poppet valve assembly 60 may further include a piston 66 coupled to the stem 62. It should be understood that the piston 66 and stem 62 can be formed integral with one another. The piston 66 may be directly coupled to the stem 62 or, alternatively, the piston 66 may be coupled to the stem 62 indirectly, i.e., through the use of an auxiliary component or components. A hydraulic coupler 68 is provided between the piston 66 and the actuator 40. The hydraulic coupler 68 can include a first plunger 70 and a second plunger 72 that are each biased in opposite directions. The first plunger 70 is biased by a first spring 74 in a direction toward the piston 66 and the second plunger 72 is biased toward the actuator 40 by a second spring 76. A pressurized fuel communicates with a space 78 between the first plunger 70 and the second plunger 72. The space 78 is in communication with the longitudinal bore 52 and a low pressure fuel return path 80. A coupler housing 82 can be disposed within a chamber of the housing 50 and can support and guide the first plunger 70 and first spring 74 as well as the second plunger 72 and the second spring 76.

In operation, a bias force holding the poppet valve assembly 60 closed is realized through any combination of spring force and high pressure fuel. This bias force must be overcome to move the poppet valve assembly 60 to an open position. Actuator 40 is operated transmitting force and motion through the second plunger 72 and pressurizing the fuel in space 78. The pressurized fuel in space 78 transmits force and motion to the first plunger 70. The force and motion from first plunger 70 is applied to the poppet valve assembly 60 overcoming the bias force resulting in the poppet valve assembly 60 to move to an open position. The volume in space 78 varies directly with the lash in the poppet valve assembly 60 and is re-filled after each injection cycle from the pressurized fuel between longitudinal bore 52 and the low pressure return path 80. The volume of fuel in space 78 eliminates lash between the actuator 40 and poppet valve assembly 60 so the desired motion transfer between actuator 40 and poppet valve assembly 60 can be realized across the operating range of the injector.

Figure 3:
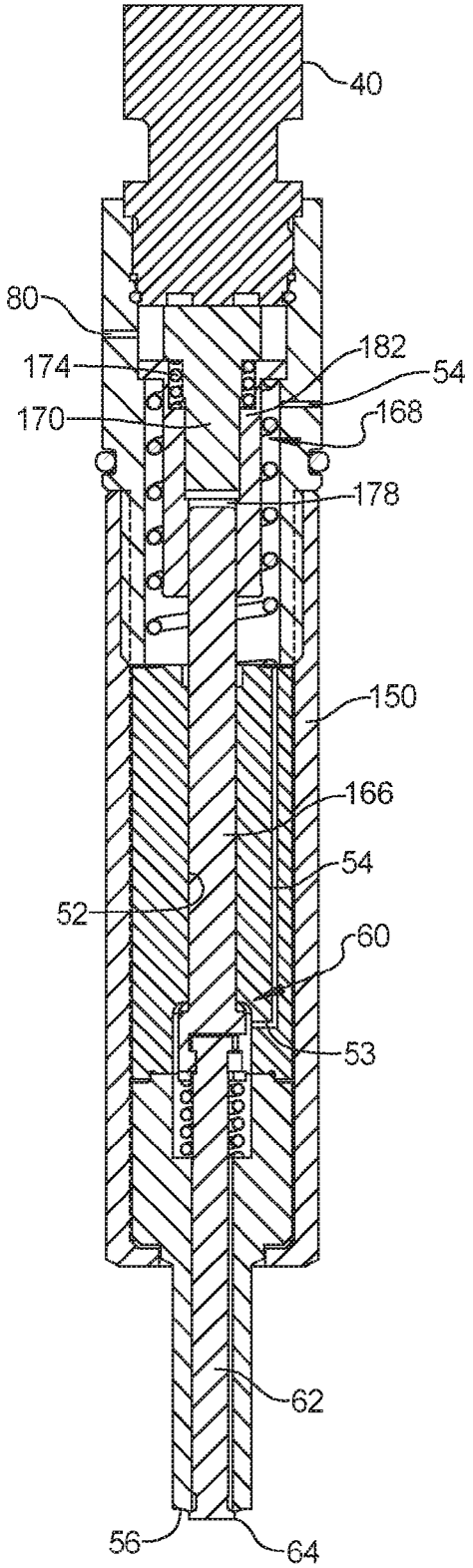
FIG. 3 is a cross sectional view of an alternative variable area poppet nozzle actuator having a hydraulic coupler according to the principles of the present disclosure.

According to an alternative embodiment as shown in FIG. 3, the hydraulic coupler 168 can include a single plunger 170 that is biased by a spring 174 in a direction toward the actuator 40. A space 178 can be defined between the plunger 170 and the piston 166 and can be filled with pressurized fuel that is in communication with the longitudinal bore 52 and a low pressure fuel return path 80. A coupler housing 182 can be disposed within a chamber of the housing 150 and can support and guide the plunger 170 and spring 174. The pressurized fuel in space 178 transmits force and motion to the first plunger 70. The force and motion from first plunger 70 is applied to the poppet valve assembly 60 overcoming the bias force resulting in the poppet valve assembly 60 to move to an open position. The volume in space 178 varies directly with the lash in the poppet valve assembly 60 and is re-filled after each injection cycle from the pressurized fuel between longitudinal bore 52 and the low pressure return path 80. The volume of fuel in space 178 eliminates lash between the actuator 40 and poppet valve assembly 60 so the desired motion transfer between actuator 40 and poppet valve assembly 60 can be realized across the operating range of the injector.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel injector, comprising:

a housing defining a longitudinal bore having a proximal end and a distal end, a high pressure fuel duct in communication with the longitudinal bore and a valve seat including a valve seat surface and an aperture at the distal end of the longitudinal bore;

a poppet valve disposed in the longitudinal bore and having a valve head that is engageable with the valve seat surface;

an actuator device disposed at the proximal end of the longitudinal bore; and a hydraulic coupler disposed between the actuator and the poppet valve within the longitudinal bore, the hydraulic coupler defining a chamber that receives low pressure fuel for providing a hydraulic lash adjuster between the actuator and the poppet valve, wherein the hydraulic coupler includes a first plunger biased toward the poppet valve by a first spring and a second plunger biased toward the actuator device by a second spring and with the chamber being disposed directly between the first plunger and the second plunger, wherein the hydraulic coupler includes a coupler housing that defines a radially outer wall of the chamber that receives and guides the first plunger and the second plunger, wherein the coupler housing includes a radially outwardly extending flange portion against which the first spring is seated, the first spring surrounding an exterior of the coupler housing and engaging a radially outwardly extending flange of the first plunger and wherein said coupler housing directly supports the second spring that biases the second plunger.

* * * * *